US008443625B2

(12) United States Patent
Prosser et al.

(10) Patent No.: US 8,443,625 B2
(45) Date of Patent: May 21, 2013

(54) KRYPTON AND XENON RECOVERY METHOD

(75) Inventors: Neil Mark Prosser, Lockport, NY (US); John Bernard Saunders, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 1112 days.

(21) Appl. No.: 12/191,584

(22) Filed: Aug. 14, 2008

(65) Prior Publication Data

US 2010/0037656 A1 Feb. 18, 2010

(51) Int. Cl.
*F25J 3/00* (2006.01)

(52) U.S. Cl.
USPC ..... 62/644; 62/643; 62/925

(58) Field of Classification Search
None
See application file for complete search history.

(56) References Cited

U.S. PATENT DOCUMENTS

| | | | | |
|---|---|---|---|---|
| 2,762,208 | A | 9/1956 | Dennis | |
| 3,751,934 | A * | 8/1973 | Frischbier | 62/653 |
| 5,067,976 | A * | 11/1991 | Agrawal et al. | 62/648 |
| 5,122,173 | A * | 6/1992 | Agrawal et al. | 62/648 |
| 5,398,514 | A * | 3/1995 | Roberts et al. | 62/646 |
| 5,675,977 | A * | 10/1997 | Prosser | 62/646 |
| 5,916,262 | A * | 6/1999 | Prosser et al. | 62/646 |
| 6,112,550 | A * | 9/2000 | Bonaquist et al. | 62/646 |
| 6,418,753 | B1 | 7/2002 | Voit et al. | |
| 6,612,129 | B2 | 9/2003 | Schwenk | |
| 2006/0021380 | A1 | 2/2006 | Jaouani et al. | |
| 2007/0044507 | A1 | 3/2007 | Wanner | |

FOREIGN PATENT DOCUMENTS

| | | | |
|---|---|---|---|
| DE | 2605305 | A1 | 8/1977 |
| DE | 10000017 | A1 | 6/2000 |
| DE | 102005040508 | | 3/2006 |
| EP | 0978699 | A1 | 2/2000 |
| EP | 1102954 | | 5/2001 |
| EP | 1308680 | | 5/2003 |

* cited by examiner

*Primary Examiner* — Marc Norman
*Assistant Examiner* — Devon Russell
(74) *Attorney, Agent, or Firm* — David M. Rosenblum

(57) ABSTRACT

A method of separating air in which a superheated air stream is introduced into a mass transfer contacting zone associated with a higher pressure column of an air separation unit. Krypton and xenon is washed from a superheated air stream introduced into the mass transfer contacting zone, thereby to form a krypton and xenon-rich liquid. The krypton and xenon-rich liquid is stripped within a stripping column to produce a krypton-xenon-rich bottoms liquid. A krypton-xenon-rich stream composed of the krypton-xenon-rich bottoms liquid from the stripping column is produced for purposes of further refinement.

10 Claims, 6 Drawing Sheets

KRYPTON AND XENON RECOVERY METHOD

FIELD OF THE INVENTION

The present invention relates to a method of separating air in an air separation unit having higher and lower pressure columns in which krypton and xenon are washed from a superheated air stream within a mass transfer contacting zone located within a bottom portion of the higher pressure column or within an auxiliary column connected to the bottom portion of the higher pressure column to produce a bottoms liquid enriched in krypton and xenon that is stripped within a stripping column to produce a further bottoms liquid that is yet further enriched in krypton and xenon.

BACKGROUND OF THE INVENTION

Air has long been separated into its component parts by cryogenic rectification. In such process, the air is compressed, purified and cooled within a main heat exchanger to a temperature suitable for its rectification and then introduced into an air separation unit having higher and lower pressure columns that operate at higher and lower pressures, respectively to produce nitrogen and oxygen-rich products. Additionally, the air separation unit can also include an argon column to separate argon from an argon-rich stream withdrawn from the lower pressure column.

The air, after having been cooled, is introduced into the higher pressure column to produce an ascending vapor phase that becomes evermore rich in nitrogen to produce a nitrogen-rich vapor overhead that is condensed to produce nitrogen-rich liquid streams that reflux both the higher and the lower pressure columns and thereby initiate the formation of the descending liquid phase within each of such columns. The descending liquid phase becomes evermore rich in oxygen as it descends to produce bottoms liquids in each of the columns that are rich in oxygen. An oxygen-rich liquid that collects within the lower pressure column as the bottoms liquid is reboiled to initiate formation of an ascending vapor phase within such column. Such reboiling can be brought about by condensing the nitrogen-rich vapor overhead of the higher pressure column to produce the nitrogen-rich reflux streams.

A stream of the oxygen-rich bottoms liquid of the higher pressure column, known in the art as crude liquid oxygen or kettle liquid, is utilized to introduce an oxygen-rich liquid stream into the lower pressure column for further refinement. Streams of nitrogen-rich vapor and residual oxygen-rich liquid that is not vaporized in the lower pressure column can be introduced into the main heat exchanger to help cool the incoming air and then be taken as products. An argon-rich stream can be removed from the lower pressure column and further refined in an argon column or column system to produce an argon-rich stream. In all such columns, mass transfer contacting elements such as structured packings, random packings or trays can be used to bring the liquid and vapor phases into intimate contact to conduct the distillation occurring within such columns.

It is known that as the liquid phase descends in the higher pressure column, that it will not only become evermore rich in oxygen, but also krypton and xenon. Due to the low relative volatility of krypton and xenon, only the bottom several stages will have appreciable concentrations of krypton and xenon. In order to concentrate the krypton and xenon, it is also known to provide a mass transfer contacting zone below the point at which the crude liquid oxygen stream is taken to wash krypton and xenon from the incoming air. For example, in DE 100 00 017 A1, an air separation plant is disclosed in which the air after having been fully cooled is introduced into the bottom of a higher pressure column having such a mass transfer contacting zone built into the bottom of the higher pressure column to produce a bottoms liquid that is rich in krypton and xenon. A stream of such bottoms liquid is then introduced into a rectification column to produce an oxygen-rich vapor overhead that is reintroduced into the higher pressure column and a crude krypton-xenon bottoms liquid that can be taken and further refined. Similarly, in US 2006/0021380, a stream of bottoms liquid rich in krypton and xenon is produced in a mass transfer contacting zone built into the bottom of the higher pressure column. The bottoms liquid is then introduced into a distillation column positioned on the top of the argon column. A condenser for the argon column reboils such distillation column to produce a residual liquid further enriched in krypton and xenon. A stream of the residual liquid is then stripped within a stripping column to produce a krypton-xenon enriched bottoms liquid that can be further refined.

As will be discussed, the present invention, among other advantages, provides an air separation method in which more krypton is able to be efficiently recovered from the incoming air than in the prior art patents discussed above.

SUMMARY OF THE INVENTION

The present invention provides a method of separating air in which the air is compressed, purified and cooled. The air is cooled such that a superheated air stream is formed from part of the air having a temperature at least about 5 K above a dew point temperature of the air at a pressure of the superheated air stream.

The air is introduced into an air separation unit that comprises a higher pressure column and a lower pressure column and the air is separated into component fractions enriched in at least oxygen and nitrogen within the air separation unit. Streams of the component fractions are utilized to assist in the cooling of the air.

Krypton and xenon are washed from at least part of the superheated air stream within a mass transfer contacting zone located in a bottom portion of the higher pressure column or in an auxiliary column connected to the bottom portion of the higher pressure column such that a bottoms liquid rich in krypton and xenon is produced. The mass transfer contacting zone is operated with a liquid to vapor ratio of between about 0.04 and about 0.15. A stream of the liquid rich in krypton and xenon is stripped within a stripping column with a stripping gas, thereby producing a krypton-xenon-rich bottoms liquid having a higher concentration of krypton and xenon than the liquid rich in krypton and xenon produced in the mass transfer contacting zone. A krypton-xenon-rich stream composed of the krypton-xenon-rich bottoms liquid is withdrawn from the stripping column.

The problem in the prior art patents is that the liquid to vapor ratio is very low in bottom sections of higher pressure columns in which krypton and xenon is to be concentrated. When air enters such a column section at a temperature at or near its dew point, given the low liquid to vapor ratio, more krypton will be in a vapor state and therefore, not recovered in the liquid. In the present invention, since the air entering the bottom of the higher pressure column is in a superheated state, the liquid to vapor ratio can be increased resulting in more krypton being washed from the vapor and therefore be present within the liquid rich in krypton and xenon and as such, the present invention allows a higher recovery of krypton than in the prior art. Also, since this is being carried out by simply introducing the air in a superheated state, the present invention can be carried out without an excessive energy penalty. Other advantages will become apparent from the description below of other aspects of the present invention.

The mass transfer contacting zone can be located in the bottom region of the higher pressure column, directly below a point at which a crude liquid oxygen stream is removed therefrom for further refinement within the air separation unit.

The air separation unit can be provided with an argon column operatively associated with the lower pressure column to rectify an argon containing stream and thereby produce an argon-rich column overhead and an argon-rich stream formed from the argon-rich column overhead. It is to be noted that as used herein and in the claims, the term "argon-rich stream" encompasses streams having any argon concentration. For example, an argon-rich stream might have sufficiently low concentrations of oxygen and nitrogen to qualify as a product stream. Such argon-rich streams are produced by a column or columns with a sufficient number of stages provided by low-pressure drop structured packing. Also, such argon-rich streams can be intermediate product streams known as crude argon streams to be further processed by such means as de-oxo units to reduce the oxygen concentration and nitrogen columns to reduce nitrogen concentration in the production of argon product. At least part of the crude liquid oxygen stream is reduced in pressure and introduced in indirect heat exchange with an argon-rich vapor stream. As a result, an argon-rich liquid stream is produced that is introduced, at least in part, into the argon column as reflux and the at least part of the crude liquid oxygen stream is partially vaporized to thereby form a vapor fraction stream and a liquid fraction stream from the partial vaporization. The vapor fraction stream is introduced into the lower pressure column and the liquid fraction stream is introduced into one of the lower pressure column and the higher pressure column.

The air can be cooled through indirect heat exchange with streams of the component fractions within a main heat exchanger. One of the streams of the component fractions is an oxygen-rich liquid stream composed of a oxygen-rich liquid column bottoms of the lower pressure column. The oxygen-rich liquid stream can be pumped and at least part of the oxygen-rich liquid stream after having been pumped can be vaporized or pseudo vaporized within the main heat exchanger to produce a pressurized oxygen product stream. The air after having been compressed and purified is divided into a first subsidiary air stream and a second subsidiary air stream. At least part of the first subsidiary air stream is further compressed, fully cooled within the main heat exchanger through vaporization or pseudo vaporization of the at least part of the oxygen-rich liquid stream and is thereafter reduced in pressure to produce a liquid containing air stream. In this regard, the term, "liquid containing air stream" as used herein and in the claims means an air stream that is either liquid or that is a two phase flow of a liquid and a vapor. The liquid containing air stream is introduced in its entirety into the higher pressure column. The second subsidiary air stream is partially cooled within the main heat exchanger to produce the superheated air stream. A liquid pseudo air stream is removed from the higher pressure column, at or above a point at which the liquid containing air stream is introduced into the higher pressure column, and introduced into the lower pressure column. The liquid fraction stream is introduced into higher pressure column at a level at which the crude liquid oxygen stream is withdrawn without mixing with the crude liquid oxygen stream to increase recovery of the krypton and xenon.

In a specific embodiment of the present invention, part of the superheated air stream can be introduced into the mass transfer contacting zone and a remaining part of the superheated air stream can be introduced into a reboiler located at the bottom of the stripping column to reboil the stripping column and thereby to form the stripping gas. The remaining part of the superheated air stream after having passed through the reboiler and at least partially condensed is combined with the liquid pseudo air stream for introduction into the lower pressure column. A nitrogen and oxygen containing vapor overhead is produced in the stripping column and a stream of the nitrogen and oxygen containing vapor overhead is introduced into the lower pressure column.

In another embodiment of the present invention, the superheated air stream, in its entirety, can be introduced into the mass transfer contacting zone. A nitrogen and oxygen containing vapor overhead is produced in the stripping column and a stream of the nitrogen and oxygen containing vapor overhead is introduced into the mass transfer contacting zone along with the superheated air stream. A first part of the first subsidiary air stream can be further compressed within a product boiler compressor and a second part of the first subsidiary air stream can be further compressed and fully cooled within the main heat exchanger. The second part of the first subsidiary air stream is introduced into a reboiler located at the bottom of the stripping column to reboil the stripping column, thereby to produce the stripping gas and the second part of the first subsidiary air stream after having passed through the reboiler and at least partially condensed is reduced in pressure and introduced into the higher pressure column.

The air can be cooled through indirect heat exchange with streams of the component fractions within a main heat exchanger. One of the streams of the component fractions is an oxygen-rich liquid stream composed of the oxygen-rich liquid column bottoms of the lower pressure column. The oxygen-rich liquid stream is pumped and at least part of the oxygen-rich liquid stream after having been pumped is vaporized or pseudo vaporized within the main heat exchanger to produce a pressurized oxygen product stream. The air after having been compressed and purified is divided into a first subsidiary air stream and a second subsidiary air stream. The first subsidiary air stream is further compressed, fully cooled within the main heat exchanger through vaporization or pseudo vaporization of the at least part of the oxygen-rich liquid stream and reduced in pressure to form a liquid containing air stream. In this embodiment, the liquid containing air stream is divided into a first subsidiary liquid containing air stream and a second subsidiary liquid containing air stream. The first subsidiary liquid containing air stream is introduced into the higher pressure column and the second subsidiary liquid containing air stream is further reduced in pressure and introduced into the lower pressure column.

The second subsidiary air stream is partially cooled within the main heat exchanger to produce the superheated air stream. The liquid fraction stream is introduced into the lower pressure column, part of the superheated air stream is introduced into the mass transfer contacting zone and a remaining part of the superheated air stream is introduced into a reboiler located at the bottom of the stripping column to reboil the stripping column, thereby to produce the stripping gas. The remaining part of the superheated air stream after having passed through the reboiler is introduced along with the second subsidiary liquid containing air stream into the lower pressure column. A nitrogen and oxygen containing vapor overhead is produced in the stripping column and a stream of the nitrogen and oxygen containing vapor overhead is introduced into the lower pressure column.

In another embodiment, the superheated air stream is introduced, in its entirety, into the mass transfer contacting zone. A nitrogen and oxygen containing vapor stream is removed from the higher pressure column at or above the point of introduction of the liquid containing air stream and introduced into a reboiler located at the bottom of the stripping column to reboil the stripping column. The nitrogen and oxygen containing vapor stream after having passed through the reboiler is introduced into the higher pressure column.

The air can be cooled through indirect heat exchange with streams of the component fractions within a main heat exchanger. One of the streams of the component fractions is an oxygen-rich liquid stream composed of the oxygen-rich liquid column bottoms of the lower pressure column. The oxygen-rich liquid stream is pumped and at least part of the oxygen-rich liquid stream after having been pumped is vaporized or pseudo vaporized within the main heat exchanger to produce a pressurized oxygen product stream. The air after having been compressed and purified is divided into a first subsidiary air stream and a second subsidiary air stream. The first subsidiary air stream is further compressed, fully cooled within the main heat exchanger through vaporization or pseudo vaporization of the at least part of the oxygen-rich liquid stream and reduced in pressure to form a liquid containing air stream. The liquid containing air stream is introduced in its entirety into the higher pressure column and the second subsidiary air stream is partially cooled within the main heat exchanger to produce the superheated air stream. A liquid pseudo air stream is removed from the higher pressure column, at or above a point at which the liquid containing air stream is introduced into the higher pressure column, and introduced into the lower pressure column.

The stream of crude liquid oxygen is divided at least into the first subsidiary crude liquid oxygen stream and a second subsidiary crude liquid oxygen stream. In such embodiment, the mass transfer contacting zone is located in the auxiliary column connected to the bottom portion of the higher pressure column. The second subsidiary crude liquid oxygen stream is introduced into the auxiliary column along with the liquid fraction stream in a countercurrent direction to the part of the superheated air stream to wash the krypton and xenon therefrom and an overhead vapor stream is returned from the auxiliary column to higher pressure column. The auxiliary column is connected to the stripping column so that the stream of the liquid rich in krypton and xenon is introduced into the stripping column. The stripping column in flow communication with the lower pressure column so that a stream of a nitrogen and oxygen containing vapor overhead produced in the stripping column is introduced into the lower pressure column along with the vapor fraction stream.

In another embodiment, the air is cooled through indirect heat exchange with streams of the component fractions within a main heat exchanger. One of the streams of the component fractions is an oxygen-rich liquid stream composed of the oxygen-rich liquid column bottoms of the lower pressure column. The oxygen-rich liquid stream is pumped and at least part of the oxygen-rich liquid stream after having been pumped is vaporized or pseudo vaporized within the main heat exchanger to produce a pressurized oxygen product stream. The air after having been compressed and purified is divided into a first subsidiary air stream and a second subsidiary air stream. The first subsidiary air stream is further compressed, fully cooled within the main heat exchanger through vaporization or pseudo vaporization of the at least part of the oxygen-rich liquid stream and reduced in pressure to form a liquid containing air stream. The second subsidiary air stream is partly cooled within the main heat exchanger to produce the superheated air stream. The liquid containing air stream is divided into a first liquid containing air stream and a second liquid containing air stream. The first liquid containing air stream is introduced into the higher pressure column and the second liquid containing air stream is introduced into the lower pressure column.

The crude liquid oxygen stream is introduced into a medium pressure column to produce a nitrogen containing column overhead and an oxygen containing column bottoms. An oxygen containing liquid column bottoms stream composed of the oxygen containing liquid column bottoms is introduced into the lower pressure column. The medium pressure column is reboiled with part of a nitrogen containing stream removed from the higher pressure column and is refluxed by condensing a nitrogen containing overhead stream composed of the nitrogen containing column overhead in an intermediate reboiler. The stripping column is reboiled with a remaining part of the nitrogen containing stream. The part of the nitrogen containing stream and the remaining part of the nitrogen containing stream are utilized to provide reflux to the higher pressure column and a nitrogen and oxygen containing vapor overhead is produced in the stripping column and a stream of the nitrogen and oxygen containing vapor overhead is introduced into the lower pressure column.

Further, the mass transfer contacting zone is located in a bottom portion of the higher pressure column, directly below a point at which the crude liquid oxygen stream is removed therefrom. A nitrogen-rich vapor stream is withdrawn from the top of the lower pressure column and constitutes a further of the streams of the component fractions. The nitrogen-rich vapor stream is introduced into the main heat exchanger. A first portion of the nitrogen-rich vapor stream is fully warmed within the main heat exchanger and a remaining portion of the nitrogen-rich vapor stream is partly warmed and withdrawn from the main heat exchanger. The remaining portion after having been withdrawn from the main heat exchanger is introduced into a turboexpander to produce an exhaust stream and the exhaust stream is re-introduced into the main heat exchanger and fully warmed to generate refrigeration. In any embodiment of the present invention, the first subsidiary air stream or part thereof as applicable can be reduced in pressure within a liquid expander.

BRIEF DESCRIPTION OF THE DRAWINGS

While the specification concludes with claims particularly pointing out the subject matter that Applicants regard as their invention, it is believed that the invention will be better understood when taken in connection with the accompanying drawings in which:

DETAILED DESCRIPTION

Figure 1:
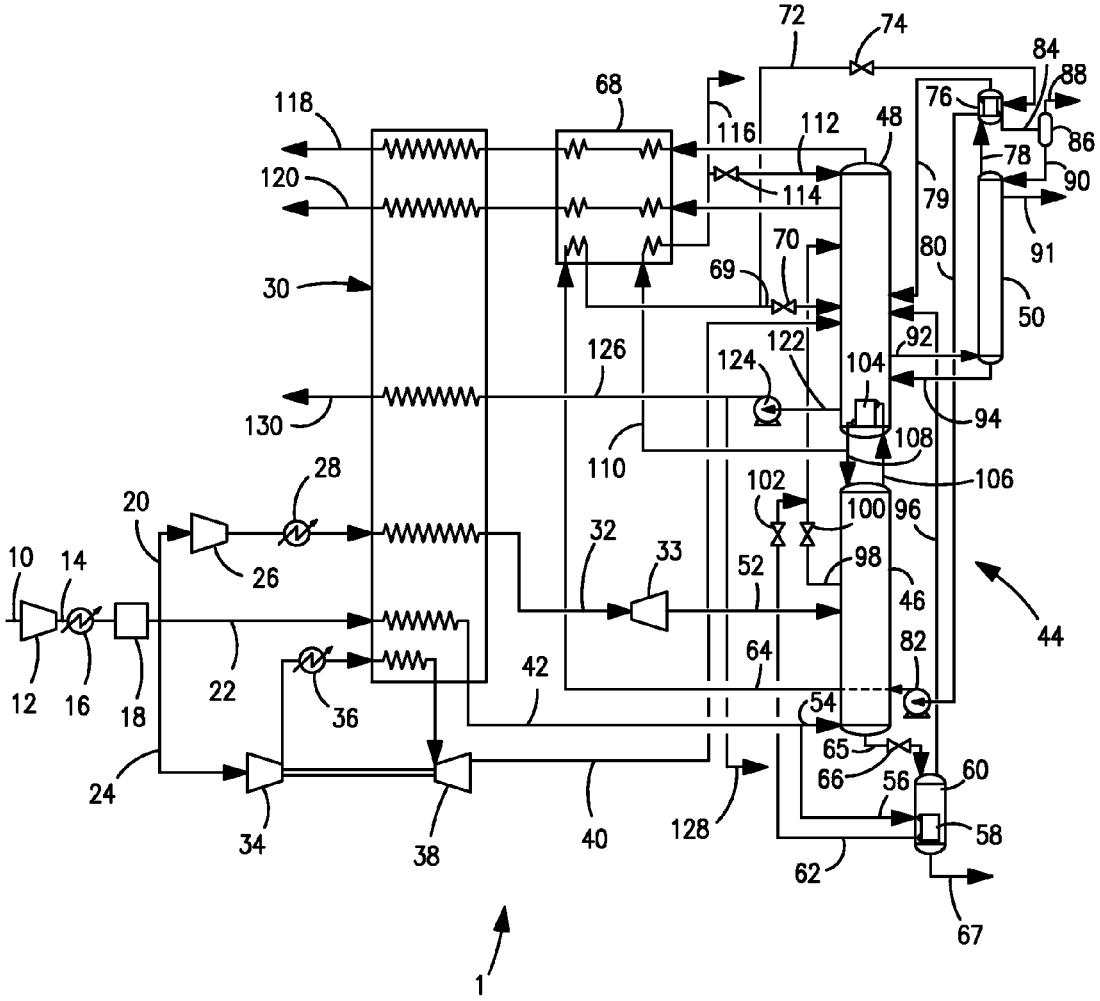
FIG. 1 is a schematic illustration of a process flow diagram of an air separation plant designed to carry out a method in accordance with the present invention.

With reference to FIG. 1, an air separation plant 1 is illustrated for carrying out a method in accordance with the present invention.

An air stream 10 is compressed in a compressor 12 to produce a compressed air stream 14 having a pressure of between about 75 psia and about 95 psia. After removal of the heat of compression within an after-cooler 16, the compressed air stream 14 is introduced into a prepurification unit 16 to produce a compressed and purified air stream 18. Prepurification unit 16 as well known in the art typically contains beds of alumina and/or molecular sieve operating in accordance with a temperature and/or pressure swing adsorption cycle in which moisture and other higher boiling impurities are adsorbed. As known in the art, such higher boiling impurities are typically, carbon dioxide, water vapor and hydrocarbons. While one bed is operating, another bed is regenerated. Other processes could be used such as direct contact water cooling, refrigeration based chilling, direct contact with chilled water and phase separation.

The compressed and purified air stream 18 is then divided into a first subsidiary air stream 20, a second subsidiary air stream 22 and a third subsidiary air stream 24. First subsidiary air stream 20, that can have a flow rate of between about 24 percent and about 35 percent of that of the compressed and purified air stream 18, is passed to booster or product boiler compressor 26 and after removal of the heat of compression within an after cooler 28 is introduced into main heat exchanger 30 to vaporize or pseudo vaporize a pumped liquid oxygen stream 126 to be discussed. After passage of first subsidiary air stream 20 through main heat exchanger 30, a fully cooled air stream 32 is produced. It is to be noted that the phrase "vaporize or pseudo vaporize" when used in connection with a pumped liquid stream and as used herein and in the claims means that the pumped stream can be above or below a supercritical pressure upon pumping such that if above the supercritical pressure, a dense phase liquid is converted to a dense phase vapor and if below the supercritical pressure, the pumped liquid undergoes a change in state from a liquid to a vapor. Third subsidiary air stream 24 preferably has a flow rate of between about 5 percent and about 20 percent of the compressed and purified air stream 18 and is passed into a booster compressor 34 and compressed to a pressure of between about 100 psia and about 180 psia. After removal of the heat of compression within an after-cooler 36, the third subsidiary air stream 24 is partly cooled within main heat exchanger 18 and introduced into a turboexpander 38 that can be coupled to the booster compressor 34 to produce an exhaust stream 40 that is used to impart refrigeration. Second subsidiary air stream 22 is partially cooled within main heat exchanger 30 to produce a superheated air stream 42.

As a further note, the term, "fully cooled" as used herein and in the claims means cooled to a temperature at the cold end of main heat exchanger 30. The term "fully warmed" means warmed to a temperature of the warm end of main heat exchanger 30. The term, "partially cooled" means cooled to a temperature between the warm and cold end temperatures of main heat exchanger 30. Lastly, the term, "partially warmed" means warmed to a temperature intermediate the cold and warm end temperatures of main heat exchanger 30.

It is to be noted that although in the embodiment of FIG. 1 and other embodiments shown herein that the main heat exchanger 30 is shown as a single unit, is intended that such main heat exchanger 30 could be formed of a separate component. For example, a separate heat exchanger could be provided to vaporize or pseudo vaporize the pumped liquid oxygen stream through indirect heat exchange with the first subsidiary air stream 20. On the other hand, subcooling heat exchanger 68 can be combined with main heat exchanger 30 such that a single heat exchange device is formed. Also, the main heat exchanger 30 could be divided at its warm and cold ends. Lastly, although the present invention is not limited to a specific type of construction for main heat exchanger 30 or the components thereof, it is understood that it could incorporate braised aluminum plate-fin construction.

The air, compressed and cooled in the manner outlined above, is then rectified within an air separation unit 44 that has a higher pressure column 46, a lower pressure column 48 and an argon column 50 to produce oxygen, nitrogen and argon products. Each of the aforementioned columns has mass transfer contacting elements to contact an ascending vapor phase with a descending liquid phase within the relevant column. Such mass transfer contacting elements can be structured packing, random packing or trays or a combination of such elements. In this regard, in the higher pressure column 46 and the lower pressure column 48, the ascending vapor phase becomes evermore rich in nitrogen as it ascends and the descending liquid phase become evermore rich in oxygen. In the higher pressure column 46, such descending liquid phase also becomes evermore rich in krypton and xenon as it descends. Due to the low relative volatility of krypton and xenon, only the bottom several stages will have appreciable concentrations of krypton and xenon. In both the higher and lower pressure columns 46, a nitrogen-rich vapor column overhead is formed at the top of each of the columns and in the lower pressure column 48 an oxygen-rich liquid column bottoms is formed. In argon column 50, oxygen is separated from argon and as a result, the descending liquid phase in this column becomes evermore rich in oxygen and the ascending vapor phase become evermore rich in argon.

More specifically, fully cooled air stream 32 is introduced into a liquid expander 33 to produce a liquid containing air stream 52 that is introduced into an intermediate location of the higher pressure column 46. A part 54 of superheated air stream 42 is introduced into the base of the higher pressure column 46 and exhaust stream 40 is introduced into the lower pressure column 48. A remaining part 56 of superheated air stream 42 is introduced into a reboiler 58 located in a stripping column 60 to form a stream 62 that is fully or partially condensed.

It is to be noted that the arrangement of booster compressor 34 and turbine 38 is preferred because it reduces the amount of air required to produce a given amount of refrigeration. Refrigeration is also produced by liquid expansion by liquid expander 33. However, there are other refrigeration possibilities, for example, waste and nitrogen expansion. A yet further possibility is to remove a stream from the higher pressure column having a composition similar to air, fully warming the same in the main heat exchanger and then compressing such stream in booster compressor 34 for refrigeration purposes. The advantage of such a possible embodiment would be to provide more superheated air to the mass transfer contacting zone and in turn wash more krypton and xenon from such superheated air. At the other extreme, it is possible to replace liquid expander 33 with a valve because refrigeration production would be lost in such a possible embodiment of the present invention.

At a bottom portion of the higher pressure column 46, an additional column section is provided below the point at which a crude liquid oxygen stream 64 is withdrawn to define a mass transfer contacting zone. This portion contains anywhere from between about 2 and 10 actual trays, preferably between about 3 and about 8 or its equivalent in packing. As will be discussed, the additional column section could be provided by an additional auxiliary column 146 to be discussed. In the present embodiment, however, the descending liquid phase within the higher pressure column 46 at such section washes krypton and xenon from the ascending vapor phase that is initiated within higher pressure column 46 by introduction of part 54 of the superheated air stream 42. As indicated above, the introduction of the main air in a superheated state allows this mass transfer contacting zone to be operated at a higher liquid to vapor ratio that could otherwise be effectively obtained with a cooler air feed to increase krypton and xenon production. In this regard, preferably, superheated air stream 42 has a temperature at least about 5 K above a dew point temperature of the air at a pressure of the superheated air stream 42. As will be discussed, further features of the air separation plant 1 help further increase the krypton-xenon recovery.

It is to be noted that the control of the liquid to vapor ratio is effectuated by the amount of liquid introduced into this mass transfer contacting zone. The liquid amount is controlled by controlling the flow rate of the crude liquid oxygen stream 64. In this regard, preferably, this mass transfer contacting zone is operated at a liquid to vapor ratio of anywhere from between about 0.04 and about 0.15. At a liquid to vapor ratio of below about 0.04, there will not be sufficient liquid to wash down the krypton. At the other extreme, at above about 0.15, it is not believed that there will be any additional benefit. Since the bottom portion of the higher pressure column 46 forms the mass transfer contacting zone, the vapor phase, after it contacts the descending liquid phase, continues to ascend within the higher pressure column. However, this washing of the krypton and xenon produces a liquid rich in krypton and xenon at the bottom of the higher pressure column.

A stream 65 of the liquid rich in krypton and xenon is reduced in pressure by an expansion valve 66 and introduced into the top of stripping column 60 to be stripped by boil-up vapor produced by reboiler 58 as a stripping gas. This produces a krypton-xenon-rich bottoms liquid within the stripping column 60 having a higher concentration of krypton and xenon than the liquid rich in krypton and xenon produced in the mass transfer contacting zone at the bottom of the higher pressure column 46. A krypton-xenon-rich stream 67 that is composed of the krypton-xenon-rich bottoms liquid can be withdrawn and further processed to produce krypton and xenon products. It is to be noted here that the down flow of the liquid phase must be controlled not only to control the liquid to vapor ratio, but also, to prevent unsafe concentrations of hydrocarbons, nitrous oxide and carbon dioxide from collecting in krypton-xenon-rich stream 67.

As mentioned above, a crude liquid oxygen stream 64 is withdrawn from the higher pressure column 46. This stream is subcooled within a subcooling unit 68. A first part 69 of the crude liquid oxygen stream 64 after having been subcooled is valve expanded in a valve 70 and introduced into lower pressure column 48 for further refinement. A second part 72 of crude liquid oxygen stream 64 is expanded in an expansion valve 74 and then introduced into a shell or boiling side of a heat exchanger 76 to condense or partially condense an argon-rich stream 78 formed of argon-rich vapor overhead of argon column 50. The condensation partially vaporizes the second part 72 of crude liquid oxygen stream 64 to form a vapor fraction stream 79 and a liquid fraction stream 80. The vapor fraction stream is introduced into lower pressure column 48 and the liquid fraction stream is pumped by a pump 82 and introduced into the higher pressure column at the same level that the crude liquid oxygen stream was extracted. The liquid fraction stream 80 would normally be introduced into lower pressure column 48. However, the partial vaporization occurring within heat exchanger 76 acts to concentrate most of the krypton and xenon within liquid fraction stream 80 that had passed in crude liquid oxygen stream 64. The reintroduction of the liquid fraction stream 80 thereby tends to increase the recovery of krypton and xenon. Additionally, the withdrawal of such liquid fraction stream 80 prevents the buildup of unsafe contaminants. A further point worth mentioning is that pump 82 could possibly be dispensed with if the heat exchanger 76 were located at a sufficient height to allow the liquid fraction stream 80 to develop sufficient head to enter the higher pressure column 46. Additionally, first part 69 of crude liquid oxygen stream 64 helps to enhance argon recovery. However, as can be appreciated, first part 69 of crude liquid oxygen stream 64 also contains krypton and xenon and could be eliminated along with valve 70 to enhance the recovery of such elements at the expense of argon recovery.

The condensation of the argon-rich stream 78 produces an argon liquid and vapor stream 84 that is introduced into a phase separator 86 to produce an argon vent stream 88 as a vapor and an argon reflux stream 90 to the argon column 50. The vapor content of stream 84 is small, generally less than about 1 percent of the total flow. Argon product stream 91 is removed from the top or near the top of argon column 50. Vent stream 88 is removed for prevention of nitrogen incursion into the argon product stream 91 when argon column 50 is designed to produce an argon product stream as opposed to a crude argon stream for further processing. Argon column 50 receives an argon and oxygen containing vapor stream 92 for separation of the oxygen from the argon. A liquid stream 94, rich in oxygen, is returned to the lower pressure column 48 from argon column 50. Depending upon the number of stages of separation and the type of mass transfer contacting elements used, for example, low pressure drop structured packing, it is possible to obtain a virtually complete oxygen separation so that argon product stream 91 is available as a product with no further process required. Typically, argon column 50 would be split into two columns for such purposes. However, it is possible to conduct a lesser separation so that argon product stream 91 is a crude argon stream to be further processed in a deoxo unit to catalytically eliminate oxygen and a nitrogen separation column to separate any nitrogen within the crude argon product.

In addition to the crude oxygen stream 64, other streams fed to the lower pressure column 48 include an oxygen and nitrogen containing stream 96 formed from column overhead produced in stripping column 60. In this regard, stripping column 60 should operate slightly above the pressure of higher pressure column 46 to allow the oxygen and nitrogen containing stream 96 to flow to lower pressure column 48. Additionally, a liquid pseudo air stream 98, so called because it has a make-up similar to air, is valve expanded and introduced into lower pressure column 98 along with stream 62 formed from a second part 56 of the superheated air stream 42 which is valve expanded in an expansion valve 102 for such purpose. The introduction of the liquid pseudo air stream 98 helps to maintain argon and oxygen recovery that would otherwise be reduced by feeding all of the liquid air to the higher pressure column 46. In this regard, the term "liquid pseudo air stream" as used herein and in the claims means a stream that contains at least about 17 percent oxygen and at least about 78 percent nitrogen.

Higher and lower pressure columns 46 and 48 are linked together in a heat transfer relationship by a condenser reboiler 104. Condenser reboiler 104 can be of the once-through down flow type. It could also be a conventional thermosiphon or a down flow type with pumped recirculation. A stream 106 of nitrogen-rich vapor, produced as column overhead in the higher pressure column 46 is introduced into condenser reboiler 104 and condensed against vaporizing oxygen-rich liquid that collects as a column bottoms within lower pressure column 48. A resulting liquid nitrogen stream is divided into first and second liquid nitrogen reflux streams 108 and 110 that are used in refluxing both the higher and lower pressure columns 46 and 48. In this regard, second liquid nitrogen reflux stream 110 is subcooled within subcooling unit 68 and a portion thereof as a liquid stream 112 is valve expanded within expansion valve 114 and introduced into the lower pressure column 48 and optionally, a remaining portion as a liquid nitrogen stream 116 can be taken as a product. Additionally, although not illustrated, higher pressure nitrogen products could be taken from stream 106 of the nitrogen-rich vapor or liquid nitrogen reflux stream 108.

A nitrogen product stream composed of column overhead of the lower pressure column 48 can be partially warmed within subcooling unit 68 to help in its subcooling duty along with a waste stream 120 that is removed to control the purity of the nitrogen product stream 118. Both such streams are then fully warmed within main heat exchanger 30 to help cool the incoming air streams. It is to be noted that waste stream 120 could be used in a manner known in the art in regenerating prepurification unit 18.

Residual oxygen-rich liquid within lower pressure column 48 that remains after vaporization of the oxygen-rich column bottoms by condenser reboiler 104 can be removed as an oxygen product stream 122 that is pumped by a pump 124 to produce a pumped oxygen stream 126 and optionally, a pressurized liquid oxygen product stream 128. Pumped oxygen product stream 126 is vaporized or pseudo vaporized within main heat exchanger 30 against the liquefaction of the first feed air stream 20, thereby to produce an oxygen product stream 130 at pressure.

Figure 2:
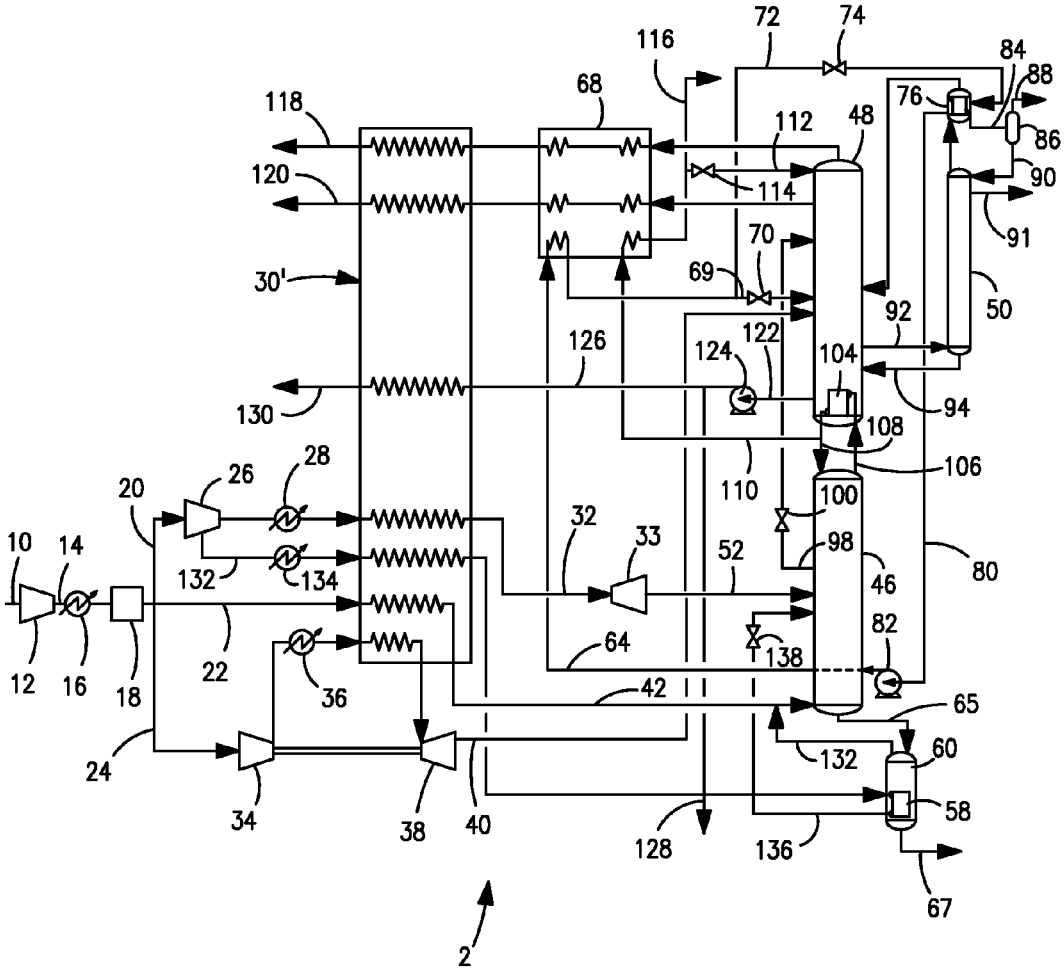
FIG. 2 is an alternative embodiment of the air separation plant illustrated in FIG. 1.

With reference to FIG. 2, an air separation plant 2 is illustrated that differs from the embodiment of FIG. 1 in that stripping column 60 operates at the nominal pressure of the higher pressure column 46, rather than as in FIG. 1, the nominal pressure of the lower pressure column 48. All of the superheated air stream 42 is introduced into the higher pressure column along with a nitrogen and oxygen containing stream 132 produced as column overhead within the stripping column 60. In this regard, stripping column 60 would operate at slightly higher pressure than higher pressure column 46 due to pressure drop within stream 132. Valve 66 can be eliminated in that there is no need for such valve. However, due to the higher operating pressure of stripping column 60, the stream fed to the reboiler must be at a higher pressure. In this regard, reboil for the stripping column 60 is produced by removing a part 132 of the first subsidiary air stream 20 from an intermediate stage of compression of booster compressor 26 at a pressure of between about 160 psia and about 250 psia. After removing the heat of compression from part 132 of first subsidiary air stream 20 in an after cooler 132, such stream is fully cooled in a main heat exchanger 30' having a passage for such purpose and introducing the stream into the reboiler 58. The resulting stream 136, that is either fully or partially condensed, is reduced in pressure by an expansion valve 138 and introduced into the higher pressure column 46 at the same location as liquid containing air stream 52 or with liquid containing air stream 52. Alternatively, stream 136 could be fed with liquid pseudo air stream 98 to the lower pressure column 48. As can be appreciated, the embodiment illustrated in FIG. 2 eliminates the argon recovery penalty that the krypton xenon recovery causes in FIG. 1. However, the higher pressure feed air requirements increases running expanses and additional complexity is required in the design of booster compressor 26 and main heat exchanger 30'.

Although not illustrated, in lieu of modification of booster compressor 26 to provide a part 132 of the first subsidiary air stream 20 from an intermediate stage of compression of booster compressor 26 for reboil purposes within stripping column 60 and modification of the main heat exchanger 30, it is possible to cold compress part of the superheated air stream 42 for such purposes. The resulting cold compressed stream could then be used for such reboiler duty. While cold compression requires less power than the warm end compression shown in FIG. 2, the energy for the cold compressor must be balanced by the requirement for additional refrigeration production in turboexpander 38. With respect to cold compression, other process streams, for example, those rich in nitrogen could be used for reboiler duty within stripping column 60.

Figure 3:
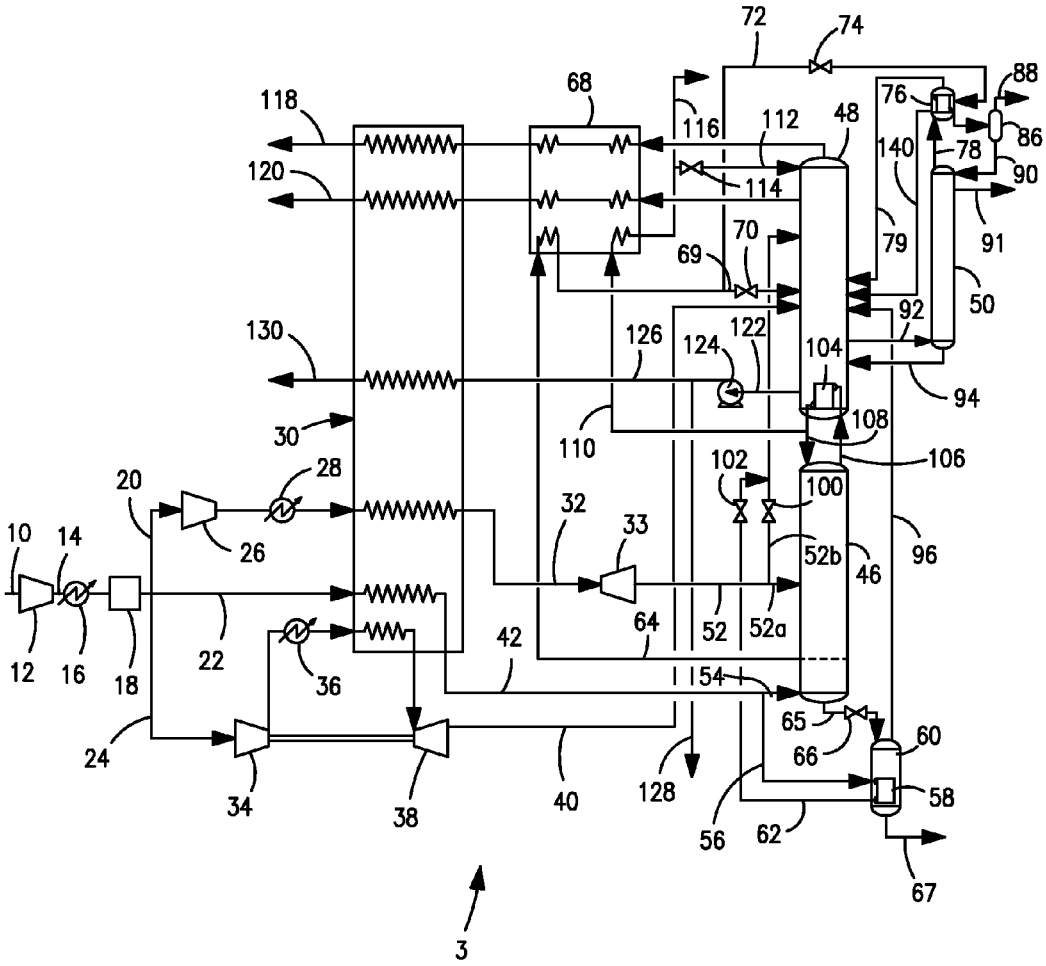
FIG. 3 is an alternative embodiment of the air separation plant illustrated in FIG. 1.

With reference to FIG. 3, an air separation plant 3 is illustrated that is a simplified version of FIG. 1 that does not include a liquid fraction stream 80 being sent back to the higher pressure column. Instead, in a conventional manner, a liquid fraction stream 140 from heat exchanger 26 is introduced into lower pressure column 48. Since liquid fraction stream 80 is not returned to the higher pressure column 46, there is no incentive for feeding all of the liquid containing air stream 52 into such column. Instead, liquid containing air stream is split into two streams 52*a* and 52*b* that are conventionally fed into the higher pressure column 46 and the lower pressure column 48.

Figure 4:
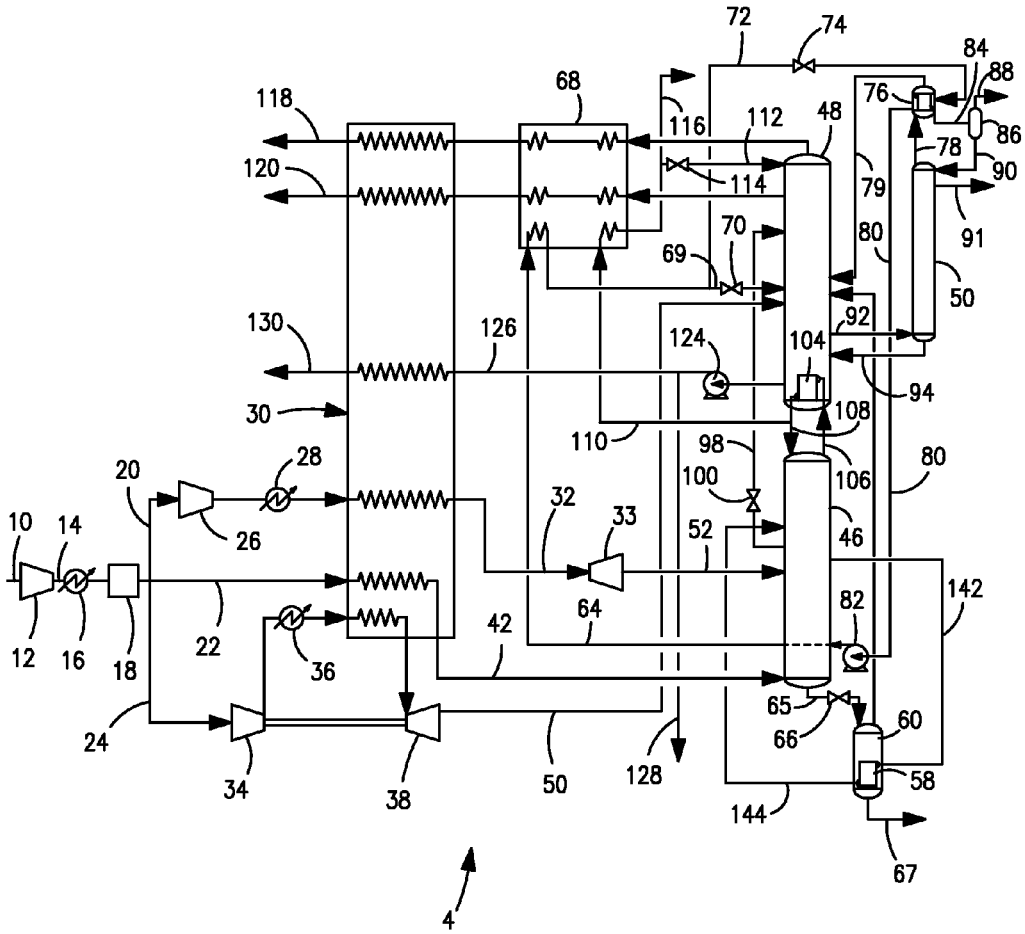
FIG. 4 is a schematic illustration of a process flow diagram of another embodiment of an air separation plant designed to carry out a method in accordance with the present invention.

With reference to FIG. 4, an air separation plant 4 is utilized in which the stripping column 60 is reboiled by removal of a vapor stream 142 from an intermediate location of the higher pressure column 46 and introducing it into reboiler 58. The location is selected so that the vapor stream 142 will have a composition that will minimize the temperature difference across reboiler 58. The resulting stream 144 that is fully or partially condensed is reintroduced back into the higher pressure column 56 at the feed point. This increases vapor and liquid traffic in higher pressure column 46 below the point at which vapor stream 142 is removed from the higher pressure column 46. As a result, the higher pressure column 4 is more effective and product argon and oxygen recoveries are improved. If structured packing is used as the mass transfer contacting element, the vapor stream 142 may be removed and the stream 144 is returned to the same location in the higher pressure column for the feed of liquid containing air stream 52. In order to feed stream 144 back into higher pressure column 46, it must have sufficient head that can be produced by a pump or the physical location of the reboiler 58. Another possibility is to let down the pressure of stream 144 and feed the same with liquid pseudo air stream 98.

Although not illustrated, it is possible to use part of the nitrogen-rich vapor stream 106 for purposes of reboiling the stripping column in lieu of vapor stream 142. The resulting stream could be combined with nitrogen reflux stream 110. While, such a modification to air separation plant 4 would result in argon and oxygen recovery enhancement, it might not allow the use of a down flow type of heat exchangers for condenser reboiler 104.

Figure 5:
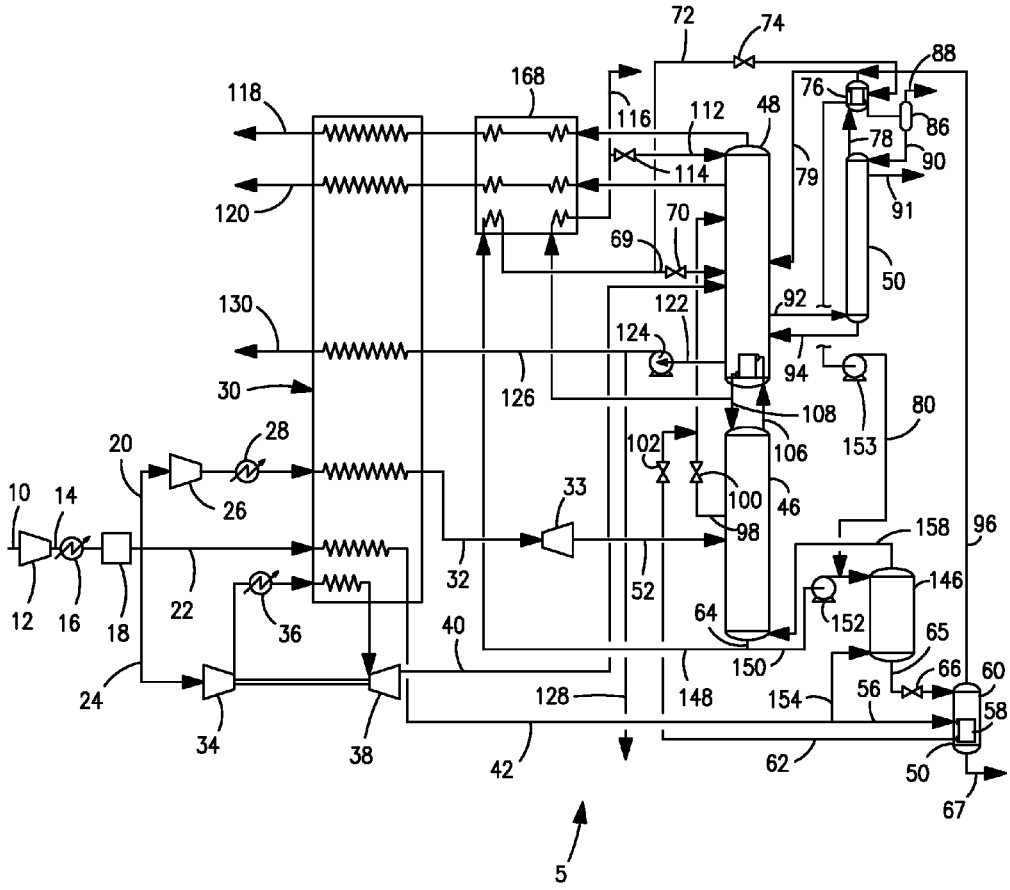
FIG. 5 is a schematic illustration of a process flow diagram of another embodiment of an air separation plant designed to carry out a method in accordance with the present invention that incorporates a separate mass transfer contacting zone located in an auxiliary column.

With reference to FIG. 5, an air separation plant 5 is illustrated in which the mass transfer contacting zone for washing the incoming superheated air stream is placed within an auxiliary column 146. The purpose of this is to allow the method of FIG. 1 to be carried out as a retrofit to an existing air separation plant. In this embodiment, the crude liquid oxygen stream 64 is divided into a first part 148 and a second part 150. The first part 148 of the crude liquid oxygen stream is introduced into the subcooling unit 168. The second part 150 of the crude liquid oxygen stream 64 and the liquid fraction stream 80 are introduced into the wash column 146. Pumps 152 and 153 can be provided to produce sufficient liquid head, if required, to introduce the aforementioned streams into wash column 146. A part 154 of the superheated air stream 42 is introduced into the wash column 146 such that the ascending phase is produced in the wash column 146. As in FIG. 1, a remaining part 56 of superheated air stream 42 is used to reboil the stripping column. However, unlike FIG. 1, a nitrogen and oxygen containing stream 96 is combined with the vapor fraction stream 79 from the heat exchanger 76 associated with argon column 50 for introduction into the lower pressure column 48. The wash column 146 is connected to a bottom region of the higher pressure column so that the ascending phase as a stream 158 passes from the wash column 146 to the higher pressure column 46 and ascends therein. As in FIG. 1, the resulting stream 65 of the liquid rich in krypton and xenon is introduced into the stripping column 60.

Figure 6:
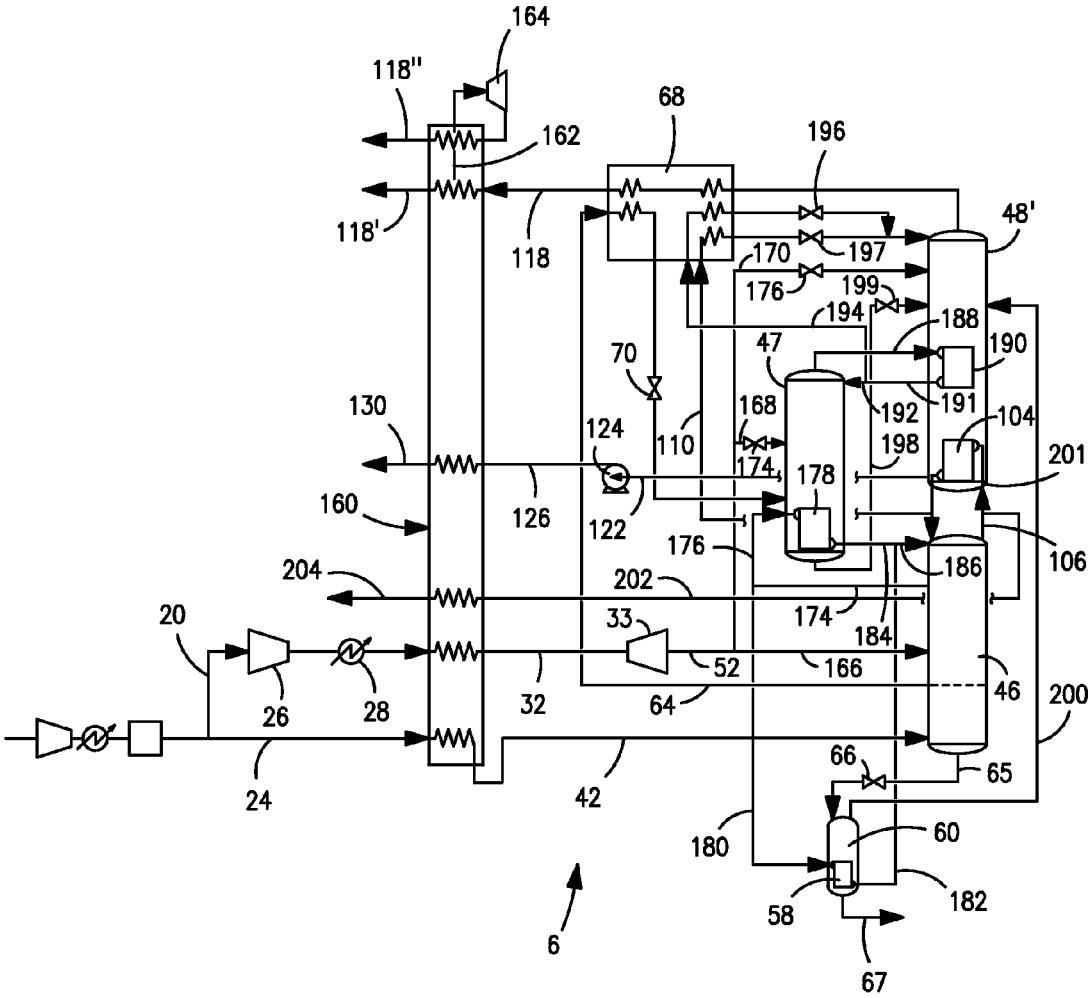
FIG. 6 is a schematic illustration of a process flow diagram of another embodiment of an air separation plant designed to carry out a method in accordance with the present invention.

With reference to FIG. 6, an air separation plant 6 is shown that employs a low purity oxygen cycle designed to produce low purity oxygen and nitrogen at high pressure and at a high rate. Air separation plant 6 employs higher pressure column 46 which may operate at a pressure of about 200 psia; a medium pressure column 47 which may operate at a pressure of about 135 psia; and lower pressure column 48' which may operate at a pressure of about 65 psia.

The advantages of such a cycle can be best understood in the context of a double column system being operated for such purposes. In such a double column cycle, there will be excess separation capability in the base of the lower pressure column 48, but will be pinched at the top of the lower pressure column. This is remedied in air separation plant 6 by reducing the mass transfer driving force at the base of the lower pressure column 48 and increasing the mass transfer driving force at the top of the lower pressure column 48. This is done by using medium pressure column 47 to extract additional nitrogen, as liquid nitrogen reflux for the lower pressure column 48'. Additionally, the lower pressure column 48' is reboiled at an intermediate level. There will be reduced reboil between the lowermost condenser reboiler within lower pressure column 48', namely, condenser reboiler 104, thereby to reduce the mass transfer driving force in such section of lower pressure column 48' where it is not needed for low purity oxygen production. The increased nitrogen reflux from the medium pressure column 47 increases the mass transfer driving force in the top section of lower pressure column 48' and thus eliminates the composition pinch. This enables greater higher pressure nitrogen product withdrawal from the higher pressure column 46 in a manner to be discussed. As can be appreciated by those skilled in the art, the capabilities of air separation plant 6 are well suited to applications involving integrated gasification combined cycles in which low purity oxygen is required by the gasifier and nitrogen feed to the gas turbine generating power.

In this particular cycle, the first feed air stream 20 and the second feed air stream 22 are cooled in a main heat exchanger 160. There is no third feed air stream in that a major part of refrigeration requirements of such a plant is provided by expanding a part of a nitrogen product stream 118. After partial warming of nitrogen product stream 118, nitrogen product stream is divided into a first nitrogen product stream 118' and an intermediate temperature nitrogen stream 162. Intermediate temperature nitrogen stream 162 is expanded in a turboexpander 164 to produce an exhaust stream that is fully warmed within main heat exchanger 160 to produce a second nitrogen product stream 118" having a lower pressure than the first nitrogen product stream 118'.

Refrigeration is also supplied by liquid expander 33. In this regard, the liquid containing air stream 52 emanating from liquid expander is divided into first, second and third subsidiary liquid containing air streams 166, 168 and 170 that are introduced into the higher pressure column 46, the medium pressure column 47 and the lower pressure column 48', respectively. Expansion valves 174 and 176 reduce the pressure of the second and third subsidiary liquid containing air streams 168 and 170 to suitable pressures for their introduction into medium pressure column 47 and lower pressure column 48'.

Crude liquid oxygen stream 64 passes through subcooling unit 68, is valve expanded by valve 70 to the pressure of the medium pressure column 47 and introduced into medium pressure column 47. A part 176 of a nitrogen containing vapor stream 174 withdrawn from the higher pressure column 46 is introduced into a reboiler 178 located in the base of medium pressure column 47 and a remaining part 180 of the nitrogen containing vapor stream 174 passed into reboiler 58 located in the stripping column 60 where it is at least partially condensed, thereby to reboil such columns. The resulting streams 182 and 184 are combined into a combined stream 186 that is introduced into the higher pressure column 46 to provide additional reflux for such column. It is to be noted that a pump may be required to allow stream 182 to be combined with condensed stream 184. A nitrogen containing stream 188 is withdrawn from the top of the medium pressure column 47 and is condensed in an intermediate reboiler 190. As illustrated, intermediate reboiler 190 may be located within the lower pressure column 48' or may be positioned outside of such column with streams passing from the lower pressure column 48' to such external intermediate reboiler. The resulting liquid nitrogen stream 191 is divided into first and second subsidiary liquid nitrogen streams 192 and 194. First subsidiary liquid nitrogen stream 192 is used to reflux the medium pressure column and second subsidiary liquid nitrogen stream 194 is combined with all of second liquid nitrogen reflux stream 110 after such streams have been subcooled and valve expanded in expansion valves 196 and 197, respectively, to reflux lower pressure column 48'. As discussed above, the intermediate reboiler 190 is positioned to reduce reboil below its level and the increased nitrogen reflux derived from the second subsidiary liquid nitrogen stream 194 and all of the second liquid nitrogen reflux stream 110 increases the mass transfer driving force in the top section of lower pressure column 48' to eliminate the composition pinch. The resulting oxygen containing stream 198 produced from the separation of nitrogen from the crude liquid oxygen stream 64 within the medium pressure column 47 is valve expanded in valve 199 and introduced into the lower pressure column 48' to supply oxygen derived from the crude liquid oxygen stream 64 and for further refinement.

A nitrogen and oxygen containing stream 200, produced as vapor column overhead of the stripping column 60 is introduced into lower pressure column 48'. Nitrogen-rich vapor stream 106 is divided into a first nitrogen-rich vapor stream 201 and a second nitrogen-rich vapor stream 202. First nitrogen-rich vapor stream 201 is introduced into condenser reboiler 104 while second nitrogen-rich vapor stream 202 is fully warmed within main heat exchanger 160 to produce a higher pressure nitrogen product stream 204 that can be drawn at a high rate for purposes of supplying a gas turbine with nitrogen.

As in the embodiment illustrated in FIG. 1, at a bottom portion of the higher pressure column 46, an additional column section is provided below the point at which a crude liquid oxygen stream 64 is withdrawn to define a mass transfer contacting zone that can be designed in the same manner as that of air separation plant 1. The descending liquid phase within the higher pressure column 46 at such section washes krypton and xenon from the ascending vapor phase that is initiated within higher pressure column 46 by introduction of all of the superheated air stream 42, superheated to the same extent as in FIG. 1, into the mass of the mass transfer contacting zone. Again, preferably, this mass transfer contacting zone is operated at a liquid to vapor ratio of anywhere from between about 0.04 and about 0.15. Since the bottom portion of the higher pressure column 46 forms the mass transfer contacting zone, the vapor phase, after it contacts the descending liquid phase continues to ascend within the higher pressure column. In this embodiment, most of the crude liquid oxygen is withdrawn in stream number 64. However, sufficient liquid exists to obtain the liquid to vapor ratio discussed above. Again, a stream 65 of the liquid rich in krypton and xenon is reduced in pressure by an expansion valve 66 and introduced into the top of stripping column 60 to be stripped by boil-up vapor produced by reboiler 58 as a stripping gas. As indicated above, a remaining part 180 of the nitrogen containing vapor stream 174 is passed into reboiler 58 for such purpose. This produces a krypton-xenon-rich bottoms liquid within the stripping column 60 having a higher concentration of krypton and xenon than the liquid rich in krypton and xenon produced in the mass transfer contacting zone at the bottom of the higher pressure column 46. A krypton-xenon-rich stream 67 that is composed of the krypton-xenon-rich bottoms liquid can be withdrawn and further produced to produce krypton and xenon products.

The following Table is a calculated example illustrating stream summaries that can be expected in the air separation plant 1 shown in FIG. 1.

TABLE

| Stream | | | | | Molar composition | | | | |
|---|---|---|---|---|---|---|---|---|---|
| Number in FIG. 1 | Flow, mol/hr | Pressure, psia | Temp., K | % vapor | N2 frac | Ar frac | O2 frac | Kr ppm | Xe ppm |
| 14[1] | 1000 | 80.2 | 284.8 | 100 | 0.7811 | 0.0093 | 0.2095 | 1.14 | 0.087 |
| 42 | 582.0 | 76.6 | 107.3 | 100 | 0.7811 | 0.0093 | 0.2095 | 1.14 | 0.087 |
| 54 | 553.0 | 76.6 | 107.3 | 100 | 0.7811 | 0.0093 | 0.2095 | 1.14 | 0.087 |
| 56 | 29.0 | 76.6 | 107.3 | 100 | 0.7811 | 0.0093 | 0.2095 | 1.14 | 0.087 |
| 52 | 295.6 | 75.9 | 97.0 | 0.010 | 0.7811 | 0.0093 | 0.2095 | 1.14 | 0.087 |
| 98 | 177.3 | 75.8 | 96.8 | 0 | 0.7930 | 0.0123 | 0.1948 | 0.098 | 0.0000 |
| 40 | 122.4 | 19.2 | 88.7 | 100 | 0.7811 | 0.0093 | 0.2095 | 1.14 | 0.087 |
| 64 | 373.6 | 76.1 | 99.4 | 0 | 0.5771 | 0.0150 | 0.4079 | 1.56 | 0.067 |
| 69[2] | 53.7 | 19.7 | 83.9 | 0.078 | 0.5771 | 0.0150 | 0.4079 | 1.56 | 0.067 |
| 72 | 319.9 | 76.1 | 91.4 | 0 | 0.5771 | 0.0150 | 0.4079 | 1.56 | 0.067 |
| 116 | 0.0 | — | — | — | — | — | — | — | — |
| 88 | 0.1 | 17.0 | 88.7 | 100 | 0.0029 | 0.9971 | 0.0000 | 0 | 0 |
| 91 | 7.5 | 17.1 | 88.8 | 0 | 0.000001 | 1.0000 | 0.000001 | 0 | 0 |
| 80 | 32.0 | 19.7 | 87.2 | 0 | 0.2912 | 0.0175 | 0.6913 | 11.5 | 0.67 |
| 79 | 287.9 | 19.7 | 87.2 | 100 | 0.6089 | 0.0148 | 0.3764 | 0.46 | 0.001 |
| 122 | 208.8 | 21.1 | 93.8 | 0 | 0.0000 | 0.0040 | 0.9960 | 2.36 | 0.082 |
| 128 | 0.0 | — | — | — | — | — | — | — | — |
| 120[3] | 297.1 | 18.8 | 79.6 | 100 | 0.9936 | 0.0031 | 0.0033 | 0 | 0 |
| 118[4] | 485.9 | 18.6 | 79.4 | 100 | 0.9999 | 0.0001 | 0.000001 | 0 | 0 |
| 62 | 29.0 | 76.6 | 96.8 | 0 | 0.7811 | 0.0093 | 0.2095 | 1.14 | 0.087 |
| 65[5] | 31.0 | 19.7 | 84.3 | 0.158 | 0.5675 | 0.0138 | 0.4186 | 22.0 | 2.26 |
| 67 | 0.6 | 20.0 | 93.0 | 0 | 0.0074 | 0.0059 | 0.9835 | 1110 | 120 |
| 96 | 30.4 | 19.7 | 87.6 | 100 | 0.5782 | 0.0140 | 0.4078 | 1.50 | 0.004 |

Note:
[1]The condition of stream 14 is given in the table after passage prepurifier 18
[2]The condition of stream 69 is given in the table after passage through valve 70
[3]The condition of stream 120 is given in the table prior to its passage through subcooling unit 68
[4]The condition of stream 118 is given in the table prior to entering subcooling unit 68
[5]The condition of stream 65 is given in the table after passage through valve 66

While the present invention has been described with reference to preferred embodiments, as would be understood by those skilled in the art, numerous changes, additions and omissions can be made in such embodiment without departing from the spirit and scope of the present invention as set forth in the appended claims.

We claim:

1. A method of separating air comprising:

compressing, purifying and cooling the air;

the air being cooled such that a superheated air stream is formed from part of the air having a temperature at least about 5 K above a dew point temperature of the air at a pressure of the superheated air stream;

introducing the air into an air separation unit comprising a higher pressure column and a lower pressure column, separating the air into component fractions enriched in at least oxygen and nitrogen within the air separation unit and utilizing streams of the component fractions to assist in the cooling of the air;

introducing at least part of the superheated air stream into a mass transfer contacting zone located in a bottom portion of the higher pressure column or in an auxiliary column connected to the bottom portion of the higher pressure column and washing krypton and xenon from the at least part of the superheated air stream within the mass transfer contacting zone such that a bottoms liquid rich in krypton and xenon is produced, the mass transfer contacting zone being operated with a liquid to vapor ratio is between about 0.04 and about 0.15;

introducing a stream of the bottoms liquid rich in krypton and xenon into the top of a stripping column and stripping the stream of the bottoms liquid with a stripping gas generated by reboiling the stripping column with a reboiler located in the bottom of the stripping column, thereby producing a krypton-xenon-rich bottoms liquid having a higher concentration of krypton and xenon than the liquid rich in krypton and xenon produced in the mass transfer contacting zone; and withdrawing a krypton-xenon-rich stream composed of the krypton-xenon-rich bottoms liquid from the stripping column.

2. The method of claim 1, wherein the mass transfer contacting zone is located in the bottom region of the higher pressure column, directly below a point at which a crude liquid oxygen stream is removed therefrom for further refinement within the air separation unit.

3. The method of claim 1, wherein:

the air separation unit has an argon column operatively associated with the lower pressure column to rectify an argon containing stream and thereby produce an argon-rich column overhead and an argon-rich stream formed from the argon-rich column overhead;

at least part of a crude liquid oxygen stream is removed from the higher pressure column, reduced in pressure and introduced in indirect heat exchange with an argon-rich vapor stream, thereby to produce an argon-rich liquid stream that is introduced, at least in part, into the argon column as reflux and to partly vaporize the at least part of the crude liquid oxygen stream and to form a vapor fraction stream and a liquid fraction stream from the partial vaporization; and the vapor fraction stream is introduced into the lower pressure column and the liquid fraction stream is introduced into one of the lower pressure column and the higher pressure column.

4. The method of claim 3, wherein:

the air is cooled through indirect heat exchange with streams of the component fractions within a main heat exchanger;

one of the streams of the component fractions is an oxygen-rich liquid stream composed of an oxygen-rich liquid column bottoms of the lower pressure column;

the oxygen-rich liquid stream is pumped and at least part of the oxygen-rich liquid stream after having been pumped is vaporized or pseudo vaporized within the main heat exchanger to produce a pressurized oxygen product stream;

the air after having been compressed and purified is divided into a first subsidiary air stream and a second subsidiary air stream;

at least part of the first subsidiary air stream is further compressed, fully cooled within the main heat exchanger through vaporization or pseudo vaporization of the at least part of the oxygen-rich liquid stream and is thereafter reduced in pressure to produce a liquid containing air stream;

the liquid containing air stream is introduced in its entirety into the higher pressure column;

the second subsidiary air stream is partially cooled within the main heat exchanger to produce the superheated air stream;

a liquid pseudo air stream is removed from the higher pressure column, above a point at which the liquid containing air stream is introduced into the higher pressure column, and introduced into the lower pressure column; and the liquid fraction stream is introduced into higher pressure column at a level at which the crude liquid oxygen stream is withdrawn without mixing with the crude liquid oxygen stream to increase recovery of the krypton and xenon.

5. The method of claim 4, wherein:

part of the superheated air stream is introduced into the mass transfer contacting zone and a remaining part of the superheated air stream is introduced into the reboiler located at the bottom of the stripping column to reboil the stripping column and thereby to form the stripping gas;

the remaining part of the superheated air stream after having passed through the reboiler and at least partially condensed is combined with the liquid pseudo air stream for introduction into the lower pressure column; and a nitrogen and oxygen containing vapor overhead is produced in the stripping column and a stream of the nitrogen and oxygen containing vapor overhead is introduced into the lower pressure column.

6. The method of claim 4, wherein:

the superheated air stream, in its entirety, is introduced into the mass transfer contacting zone;

a nitrogen and oxygen containing vapor overhead is produced in the stripping column and a stream of the nitrogen and oxygen containing vapor overhead is introduced into the mass transfer contacting zone along with the superheated air stream;

a first part of the first subsidiary air stream is further compressed within a product boiler compressor and a second part of the first subsidiary air stream is further compressed and is fully cooled within the main heat exchanger;

the second part of the first subsidiary air stream is introduced into a reboiler located at the bottom of the stripping column to reboil the stripping column; and the second part of the first subsidiary air stream after having passed through the reboiler and at least partially condensed is reduced in pressure and introduced into the higher pressure column.

7. The method of claim 3, wherein:

the air is cooled through indirect heat exchange with streams of the component fractions within a main heat exchanger;

one of the streams of the component fractions is an oxygen-rich liquid stream composed of the oxygen-rich liquid column bottoms of the lower pressure column;

the oxygen-rich liquid stream is pumped and at least part of the oxygen-rich liquid stream after having been pumped is vaporized or pseudo vaporized within the main heat exchanger to produce a pressurized oxygen product stream;

the air after having been compressed and purified is divided into a first subsidiary air stream and a second subsidiary air stream;

the first subsidiary air stream is further compressed, fully cooled within the main heat exchanger through vaporization or pseudo vaporization of the at least part of the oxygen-rich liquid stream and reduced in pressure to form a liquid containing air stream;

the liquid containing air stream is divided into a first subsidiary liquid containing air stream and a second subsidiary liquid containing air stream, the first subsidiary liquid containing air stream is introduced into the higher pressure column and the second subsidiary liquid containing air stream is further reduced in pressure and introduced into the lower pressure column;

the second subsidiary air stream is partially cooled within the main heat exchanger to produce the superheated air stream;

the liquid fraction stream is introduced into the lower pressure column;

part of the superheated air stream is introduced into the mass transfer contacting zone and a remaining part of the superheated air stream is introduced into the reboiler located at the bottom of the stripping column to reboil the stripping column and thereby to form the stripping gas;

the remaining part of the superheated air stream after having passed through the reboiler is introduced along with the second subsidiary liquid containing air stream into the lower pressure column; and a nitrogen and oxygen containing vapor overhead is produced in the stripping column and a stream of the nitrogen and oxygen containing vapor overhead is introduced into the lower pressure column.

8. The method of claim 4, wherein:

the superheated air stream is introduced, in its entirety, into the mass transfer contacting zone;

a nitrogen and oxygen containing vapor stream is removed from the higher pressure column above the point of introduction of the liquid containing air stream and introduced into a reboiler located at the bottom of the stripping column to reboil the stripping column; and the nitrogen and oxygen containing vapor stream after having passed through the reboiler is introduced into the higher pressure column.

9. The method of claim 4, wherein the at least part of the first subsidiary air stream is reduced in pressure within a liquid expander.

10. The method of claim 7, wherein the first subsidiary air stream is reduced in pressure within a liquid expander.

* * * * *